US008121524B2

(12) United States Patent
Sakoh et al.

(10) Patent No.: US 8,121,524 B2
(45) Date of Patent: Feb. 21, 2012

(54) DEVELOPER SUPPLY CONTAINER AND IMAGE FORMING APPARATUS

(75) Inventors: Kiyoshi Sakoh, Saitama (JP); Takuji Matsumoto, Saitama (JP); Kazuhiro Saito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1072 days.

(21) Appl. No.: 12/014,831

(22) Filed: Jan. 16, 2008

(65) Prior Publication Data

US 2008/0279594 A1 Nov. 13, 2008

(30) Foreign Application Priority Data

May 7, 2007 (JP) ..... 2007-122738

(51) Int. Cl.
*G03G 15/08* (2006.01)

(52) U.S. Cl. ..... 399/262; 399/120; 399/263

(58) Field of Classification Search ..... 399/262, 399/263, 253, 258, 120
See application file for complete search history.

(56) References Cited

U.S. PATENT DOCUMENTS

| | | | | |
|---|---|---|---|---|
| 5,491,537 | A | 2/1996 | Suzuki et al. | |
| 5,557,382 | A | 9/1996 | Tatsumi et al. | |
| 5,568,237 | A | 10/1996 | Ishida et al. | |
| 5,612,770 | A | 3/1997 | Bandai et al. | |
| 5,890,034 | A * | 3/1999 | Nakano et al. | 399/106 |
| 6,219,506 | B1 | 4/2001 | Morinaga et al. | |
| 6,385,422 | B1 | 5/2002 | Ishiguro et al. | |
| 6,456,810 | B1 | 9/2002 | Deguchi et al. | |
| 6,526,245 | B1 | 2/2003 | Yamashita | |
| 7,058,342 | B2 | 6/2006 | Jeon | |
| 7,068,968 | B2 * | 6/2006 | Choi et al. | 399/360 |
| 7,209,685 | B2 | 4/2007 | Oyama et al. | |
| 7,532,844 | B2 | 5/2009 | Tanaka | |
| 7,561,835 | B2 | 7/2009 | Tanaka et al. | |
| 7,873,308 | B2 * | 1/2011 | Saito et al. | 399/263 |
| 7,941,073 | B2 * | 5/2011 | Takagi et al. | 399/120 |
| 2006/0147228 | A1 | 7/2006 | Nagahama et al. | |
| 2007/0264051 | A1 | 11/2007 | Tanaka | |
| 2007/0280739 | A1 | 12/2007 | Tanaka | |

FOREIGN PATENT DOCUMENTS

| | | | |
|---|---|---|---|
| AU | 2007-201530 | A1 | 11/2007 |
| CN | 1823307 | A | 8/2006 |
| JP | 7-287448 | A | 10/1995 |

(Continued)

OTHER PUBLICATIONS

Notification of Reason for Refusal issued Jun. 1, 2010 in Japanese Application No. 2007-122738.

(Continued)

*Primary Examiner* — David Gray
*Assistant Examiner* — Roy Y Yi
(74) *Attorney, Agent, or Firm* — Sughrue Mion, PLLC

(57) ABSTRACT

A developer supply container includes a container body, a developer conveyance member, and a clog prevention member. The container body includes an outlet port and contains developer therein. The developer conveyance member includes a rotational shaft and a conveyance-member body. The conveyance-member body is supported by the rotational shaft and has flexibility. The developer conveyance member is disposed in the container body and conveys the developer to the outlet port for discharge. The clog prevention member is formed in the conveyance-member body in a position corresponding to the outlet port. The clog prevention member goes into the outlet port to protrude to outside of the container body as the rotational shaft rotates.

7 Claims, 16 Drawing Sheets

FOREIGN PATENT DOCUMENTS

| | | | |
|---|---|---|---|
| JP | 2000-003118 | A | 1/2000 |
| JP | 2000250296 | A | 9/2000 |
| JP | 2001100501 | A | 4/2001 |
| JP | 2001194887 | A | 7/2001 |
| JP | 2001-318517 | A | 11/2001 |
| JP | 2002-006610 | A | 1/2002 |
| JP | 2002040786 | A | 2/2002 |
| JP | 2002040788 | A | 2/2002 |
| JP | 2002236410 | A | 8/2002 |
| JP | 2002-287475 | A | 10/2002 |
| JP | 2003-156927 | A | 5/2003 |
| JP | 2003186294 | A | 7/2003 |
| JP | 2004-301975 | A | 10/2004 |
| JP | 2005031299 | A | 2/2005 |
| JP | 2005134817 | A | 5/2005 |
| JP | 2005-181366 | A | 7/2005 |
| JP | 2007-034323 | A | 2/2007 |

OTHER PUBLICATIONS

Australian Office Action dated Jul. 20, 2009.

U.S. Appl. No. 11/636,468, filed by Hideaki Tanaka, Dec. 11, 2006.

Chinese Office Action dated Apr. 6, 2010.

* cited by examiner

DEVELOPER SUPPLY CONTAINER AND IMAGE FORMING APPARATUS

CROSS-REFERENCE TO RELATED APPLICATIONS

This application is based on and claims priority under 35 U.S.C. §119 from Japanese Patent Application No. 2007-122738 filed on May 7, 2007.

BACKGROUND

1. Technical Field

The invention relates to a developer supply container and an image forming apparatus.

2. Related Art

In image forming apparatuses such as an electrophotographic-type copier and an electrophotographic-type printer, a developing device develops a latent image formed on a surface of a photoconductor, and the developed visible image is transferred to a medium and fixed thereon, thereby forming an image. In such an image forming apparatus, developer for use in image formation is supplied from a developer supply container, that is, a so-called toner cartridge to the developing device.

SUMMARY

According to an aspect of the invention, a developer supply container includes a container body, a developer conveyance member, and a clog prevention member. The container body includes an outlet port and contains and contains developer therein. The developer conveyance member includes a rotational shaft and a conveyance-member body. The conveyance-member body is supported by the rotational shaft and has flexibility. The developer conveyance member is disposed in the container body and conveys the developer to the outlet port for discharge. The clog prevention member is formed in the conveyance-member body in a position corresponding to the outlet port. The clog prevention member goes into the outlet port to protrude to outside of the container body as the rotational shaft rotates.

BRIEF DESCRIPTION OF THE DRAWINGS

Exemplary embodiments of the invention will be described below in detail with reference to the accompanying drawings, wherein:

FIG. 5 is an explanatory view illustrating a developer conveyance device according to the exemplary embodiment 1 of the invention.

FIG. 12 is an explanatory view illustrating a rotational shaft of an agitator as an example of the developer conveyance member according to the exemplary embodiment 1.

FIG. 14 is an explanatory view illustrating a relationship between a clog prevention member and a supply developer outlet port according to the exemplary embodiment 1.

DETAILED DESCRIPTION

Figure 1:
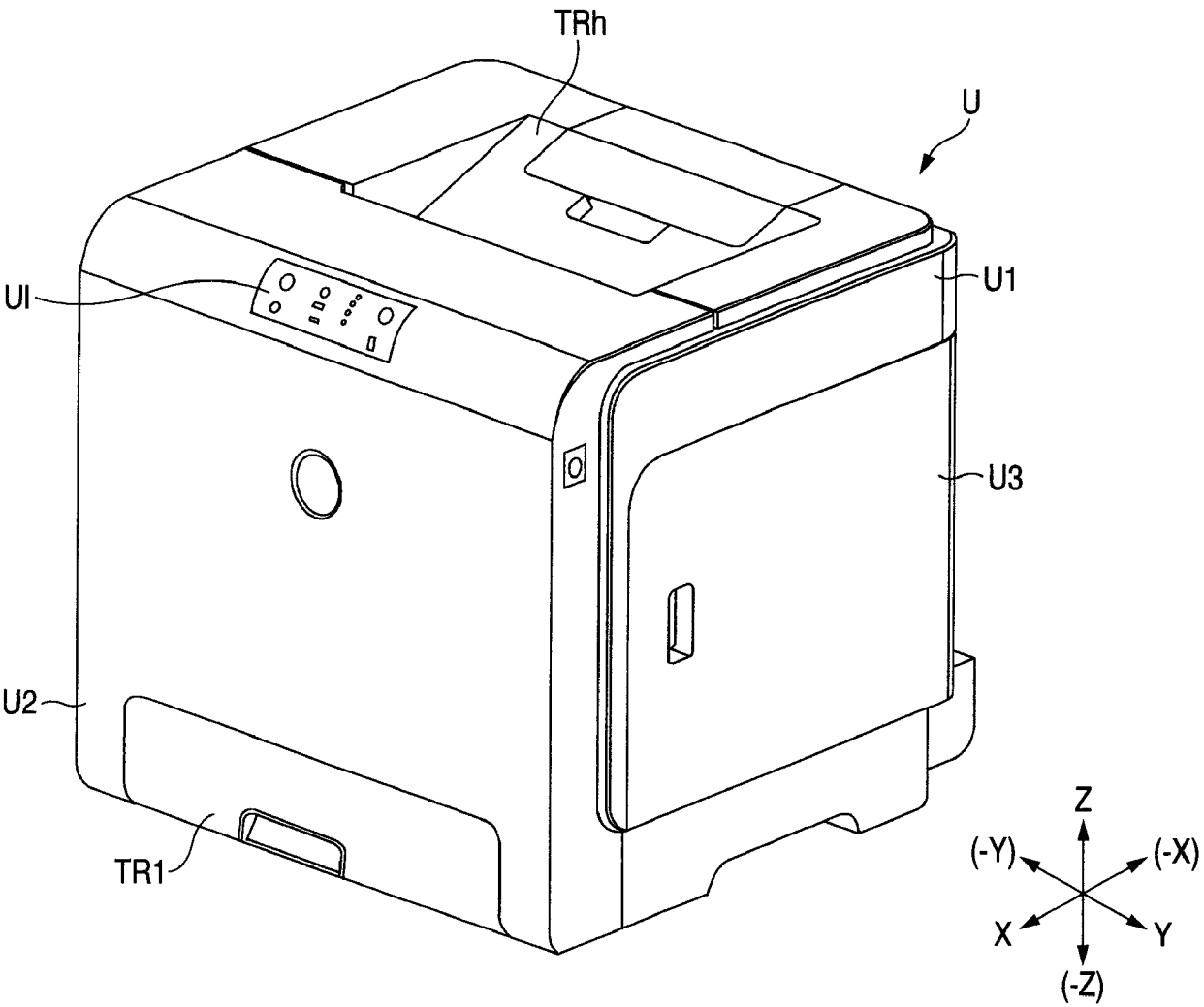
FIG. 1 is a perspective explanatory view illustrating an image forming apparatus according to an exemplary embodiment 1 of the invention.

Referring to the drawings, exemplary embodiments of the invention will be described in detail. However, it should be noted that the invention is not limited to the following exemplary embodiments. In order to facilitate understanding of the following description, the following definition is used in the drawings: It is assumed that a front and rear direction is an X axial direction, a left direction is a Y axial direction and an up and down direction is a Z axial direction. Also, directions of side represented by arrows X, −X, Y, −Y, and Z, −Z will be referred to as a frontward direction, a rear direction, a right direction, a left direction, an upper direction, and a lower direction, or referred to as a front side, a rear side, a right side, a left side, an upper side, and a lower side, respectively.

In the drawings, a reference sign having a shape of '·' in 'O' represents an arrow from the rear side of paper toward its front side, and a reference sign having a shape of 'x' in 'O' represents an arrow from the front side of paper toward its rear side.

In the description with reference to the drawings, members other than those needed for description will be appropriately omitted in order to facilitate understanding.

Exemplary Embodiment 1

FIG. 1 is a perspective explanatory view illustrating an image forming apparatus according to an exemplary embodiment 1 of the invention.

Figure 2:
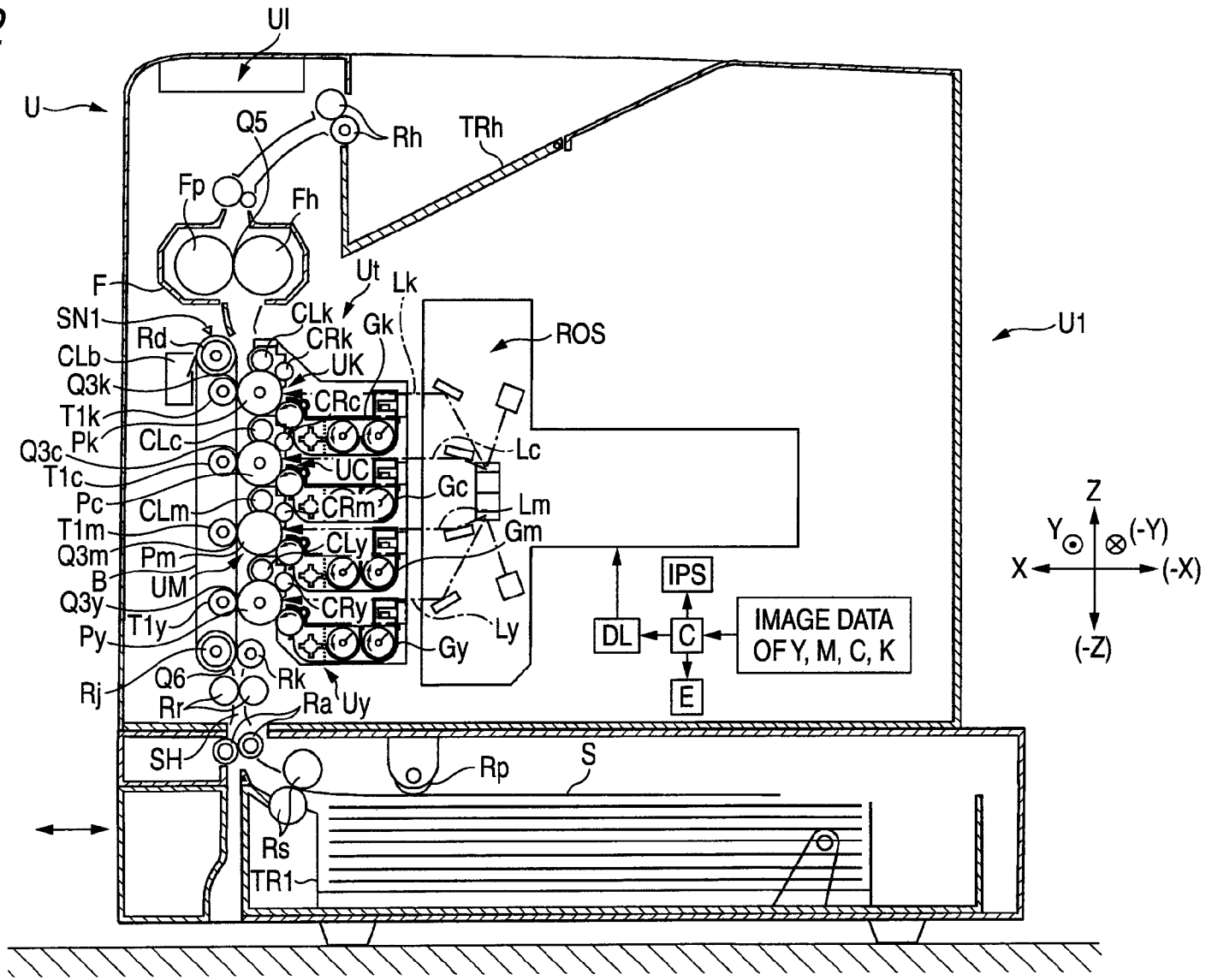
FIG. 2 is an overall explanatory view illustrating the image forming apparatus according to the exemplary embodiment 1 of the invention.

FIG. 2 is an overall explanatory view illustrating the image forming apparatus according to the exemplary embodiment 1 of the invention.

Figure 3:
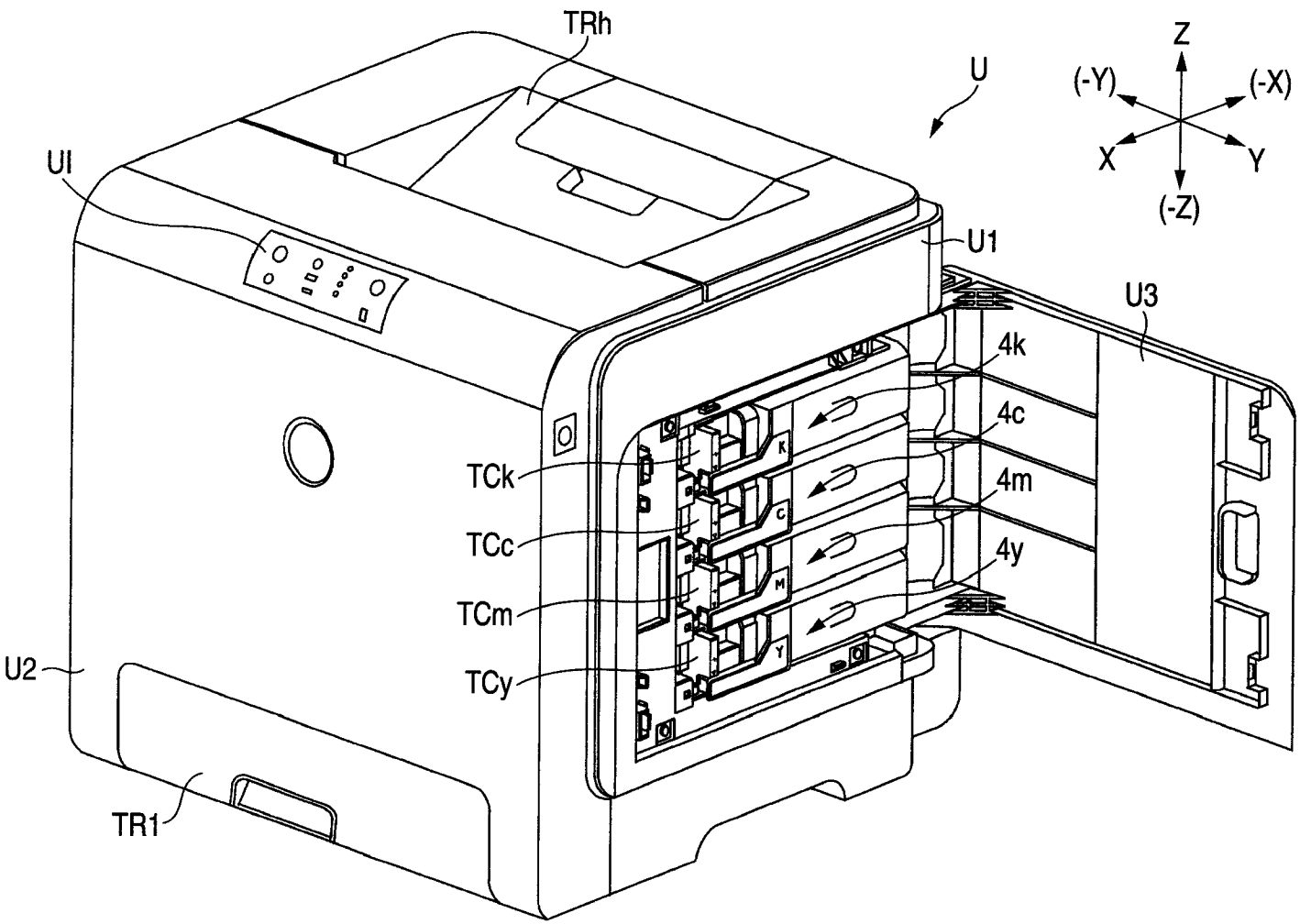
FIG. 3 is a perspective explanatory view illustrating a state where a side cover of the image forming apparatus according to the exemplary embodiment 1 of the invention is opened.

FIG. 3 is a perspective explanatory view illustrating a state where a side cover of the image forming apparatus according to the exemplary embodiment 1 of the invention is opened.

In FIGS. 1 to 3, a printer U is an example of an image forming apparatus according to the exemplary embodiment 1 of the invention. In the printer U, a paper feeding tray TR1 that houses a recording medium S as an example of a medium on which an image is recorded is disposed in its lower part, and a paper ejection tray TRh is disposed on its upper face. Also, an operation section UI is disposed on an upper part of the printer U.

The printer U according to the exemplary embodiment 1 includes an image forming apparatus body U1, a front cover U2 as an example of an openable portion disposed on the front side of the image forming apparatus body U1, and a side cover U3 as an example of an openable portion disposed on the side of the image forming apparatus body U1. The front cover U2 opens when an inside of the image forming apparatus body U1 opens in order to supply developer, exchange a disabled member, or remove a jammed recording medium S. The side cover U3 opens when the developer supply container, that is, a so-called toner cartridge is exchanged. In FIG. 3, when the side cover U3 of the printer U is moved to an open position, a side wall of the printer U opens, and it is possible to deal with toner cartridges TCy, TCm, TCc, and TCk as examples of the developer accommodation container.

In FIG. 2, the printer U includes a control section C that performs various control operations of the printer U; an image processing section IPS controlled by the control section C; an image-writing-device driving circuit DL; and a power supplier E. The power supplier E applies a voltage to charging rollers CRy to CRk as examples of a charging device to be described later, a developing roller as an example of a developer carrier, and transfer rollers T1*y* to T1*k* as examples of a transfer device.

The image processing section IPS converts print information input from an external image information transmission apparatus into image information for latent image formation that corresponds to images of four colors of Y (yellow), M (magenta), C (cyan), and K (black), and outputs the information to the image-writing-device driving circuit DL at a predetermined timing. The image-writing-device driving circuit DL outputs a drive signal to a latent-image writing device ROS in accordance with the input image information of the respective colors. The latent-image writing device ROS emits laser beams Ly, Lm, Lc, and Lk as examples of image writing light for writing images of the respective colors, in accordance with the drive signal.

In FIG. 2, in the right direction (+Y direction) of the latent-image writing device ROS, visible image forming devices UY, UM, UC, and UK that form toner images as examples of visible images of the respective colors of K (black), Y (yellow), M (magenta), and C (cyan) are disposed.

The visible image forming device UK of K (black) includes a photoconductor Pk as an example of a rotatable image carrier. In the vicinity of the photoconductor Pk, there is provided the charging roller CRk as an example of the charging device, a developing device Gk that develops an electrostatic latent image on a surface of the photoconductor Pk into a visible image, a photoconductor cleaner CLk as an example of an image carrier cleaner that removes developer remaining on the surface of the photoconductor Pk.

After the surface of the photoconductor Pk is uniformly charged by the charging roller CRk in a charging region Q1*k* in which the photoconductor Pk is opposed to the charging roller CRk, the latent image is written by a laser beam LK in a latent image forming region. The written electrostatic latent image is developed into a visible image in a developing region in which the photoconductor Pk is opposed to the developing device Gk. The visible image forming device UK of black according to the exemplary embodiment 1 includes: an exchangeable image carrier cartridge in which the photoconductor Pk, the charging device CRk, and the photoconductor cleaner CLk are integrally formed; and an exchangeable developing cartridge having the developing device Gk.

Like the visible image forming device UK of black, each of the visible image forming devices UY, UM, and UC of the other colors includes an image carrier cartridge and a developing cartridge, which are detachable from the image forming apparatus body U1. Also, in the exemplary embodiment 1, the four visible image forming devices UY to UK are held by a so-called exchange frame Ut, and the four visible image forming devices UY to UK are configured to be integrally exchangeable with respect to the image forming apparatus body U1.

In FIG. 2, in the front of the photoconductors Py to Pk, a belt module BM is disposed as an example of a recording-medium conveyance device supported by the openable portion U2. The belt module BM includes: a medium conveyance belt B as an example of a recording-medium carry/conveyance member; a belt drive roller Rd as an example of a drive member that supports the medium conveyance belt B; a belt support roller (Rd+Rj) as an example of a carry/conveyance-member support system including a driven roller Rj as an example of a driven member; the transfer rollers T1*y*, T1*m*, T1*c*, and T1*k* as examples of the transfer devices disposed so as to face the photoconductors Py to Pk; a belt cleaner CLb as an example of a carry/conveyance-member cleaner; and a medium adsorption roller Rk as an example of a recording medium adsorption member that is disposed so as to face the driven roller Rj and makes the recording medium S to be adsorbed to the medium conveyance belt B. The medium conveyance belt B is rotatably supported by the belt support rollers (Rd+Rj).

At predetermined time period, an image density sensor SN1 detects a density of an image for density detection, that is, a so-called patch image formed by an image density adjustment unit, which is not shown in the drawings, of the control section C. The image density adjustment unit, on the basis of the image density detected by the image density sensor SN, adjusts voltages applied to the charging devices CRy to CRk, the developing devices Gy to Gk, and the transfer rollers T1*y* to T1*k*, and adjusts intensities of latent image writing light Ly to Lk, thereby adjust and correct the image densities, that is, a so-called process control.

The recording medium S of the paper feeding tray TR1 disposed below the medium conveyance belt B is fed out by a paper feeding member Rp, and is conveyed to a recording-medium conveyance path SH. The recording medium S in the recording-medium conveyance path SH is conveyed by a medium conveyance roller Ra as an example of a recording medium conveyance member, and is sent to register rollers Rr as an example of a paper feeding time adjustment member. The register rollers Rr convey, at a predetermined time, the recording medium S to a recording medium adsorption position Q6 that is in a region where the driven roller Rj is opposed to the medium adsorption roller Rk. The recording medium S conveyed to the recording medium adsorption position Q6 is electrostatically adsorbed to the medium conveyance belt B.

The recording medium S adsorbed to the medium conveyance belt B sequentially passes through transfer regions Q3*y*, Q3*m*, Q3*c*, and Q3*k* in which the recording medium is brought into contact with the photoconductors Py to Pk.

Transfer voltages having a polarity opposed to a charged polarity of the toner are applied at a predetermined time from the power supply circuit E controlled by the control section C to the transfer rollers T1*y*, T1*m*, T1*c*, and T1*k*, which are disposed on the rear side of the medium conveyance belt B in the transfer regions Q3*y*, Q3*m*, Q3*c* and Q3*k*.

In case of a multi-color image, the toner images on the photoconductors Py to Pk are superposed on and transferred to the recording medium S on the medium conveyance belt B by the transfer rollers T1*y*, T1*m*, T1*c*, and T1*k*. In case of a single-color image, for example, a monochrome image, only the toner image of K (black) is formed on the photoconductor Pk, and the tone image of K (black) is transferred to the recording medium S by the transfer device T1*k*. After the toner images are transferred, the photoconductor cleaners CLy to CLk collect and clean the toner remaining on the surfaces of the photoconductors Py to Pk, and the photoconductors Py to Pk are charged again by the charging rollers CRy to CRk.

The recording medium S to which the toner images are transferred is subject to fixing in a fixing region Q5 that is formed by a hating roller Fh as an example of a heating fixation member of a fixing device F as an example of a fuser and a pressing roller Fp as an example of a pressing fixation member in contact with each other. The recording medium S on which the image is fixed is discharged from discharging rollers Rh as an example of a medium discharging member to the medium discharging portion TRh.

After the recording medium S is discharged, the medium conveyance belt B is cleaned by the belt cleaner CLb.

(Description of Developer Conveyance Device)

Figure 4:
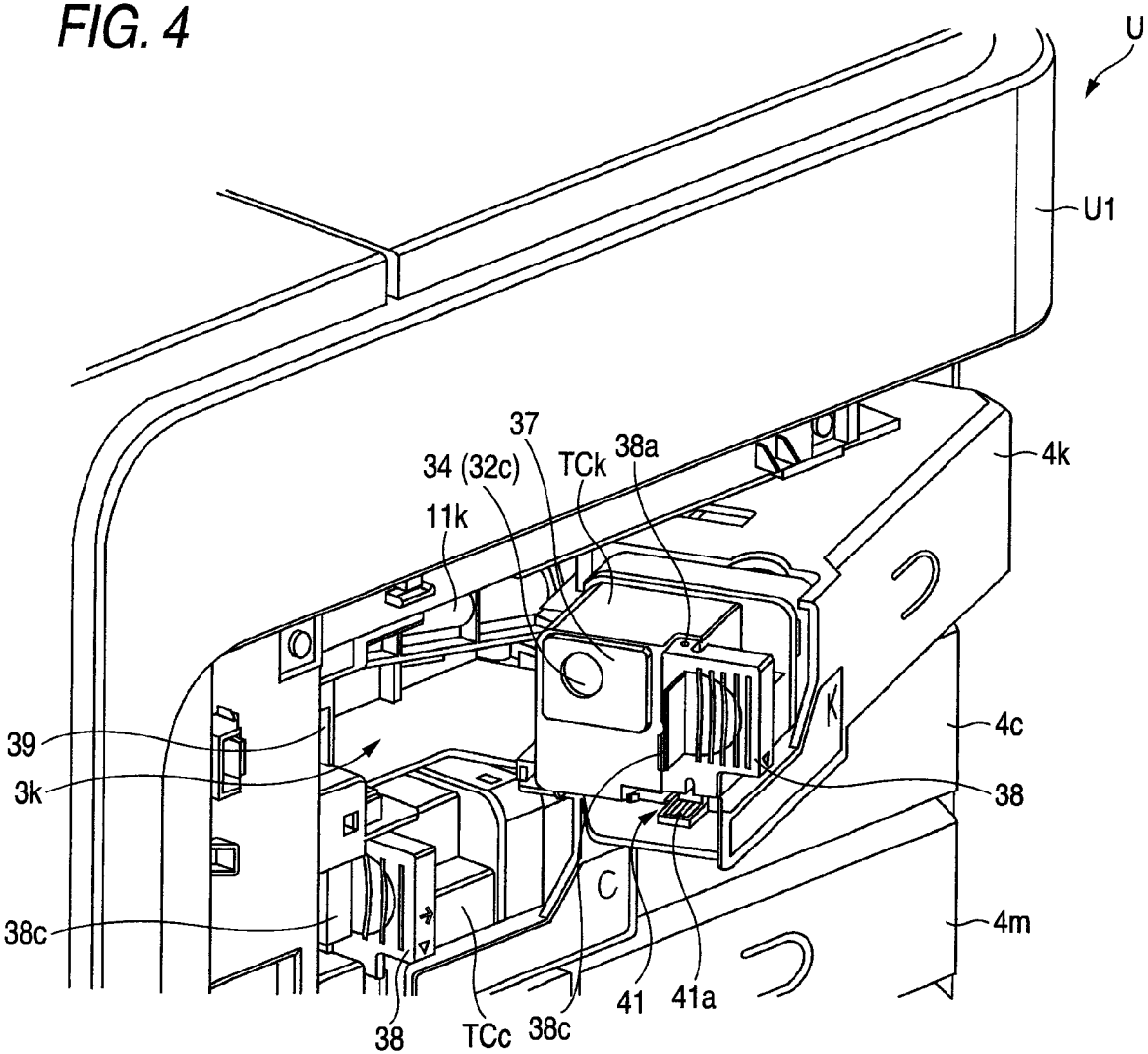
FIG. 4 is an explanatory view illustrating a state where a toner cartridge as an example of a developer accommodation container is attached and detached.

FIG. 4 is an explanatory view illustrating a state where the toner cartridge as an example of a developer accommodation container is attached and detached.

Figure 5B:
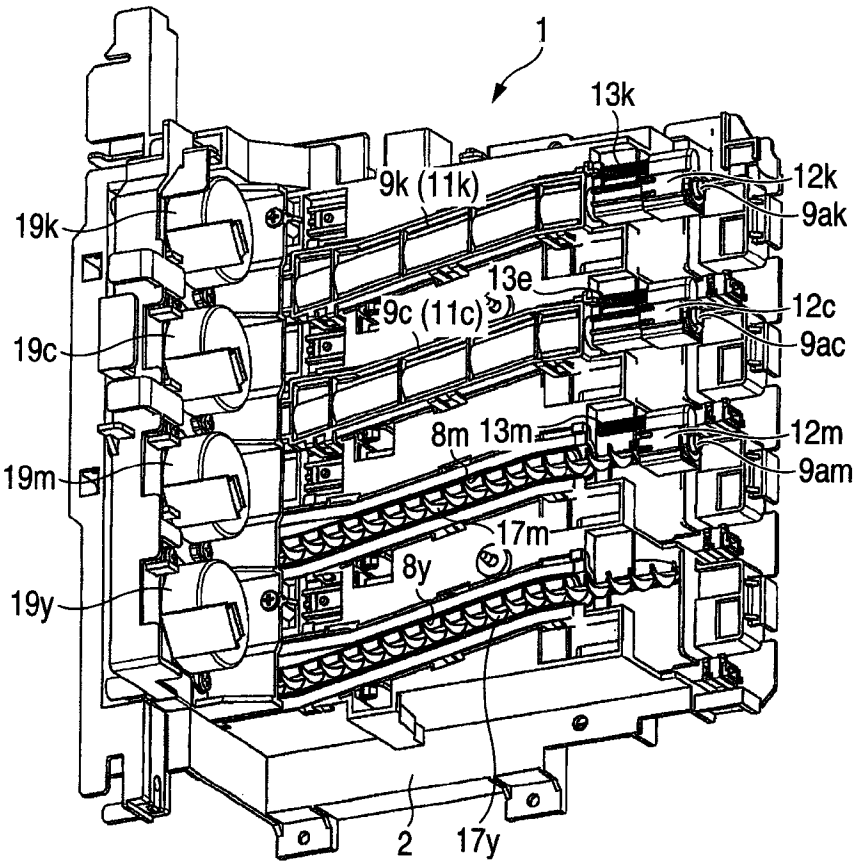
FIG. 5B is a view thereof when viewed from the direction of an arrow VB in FIG. 5A.
Figure 5A:
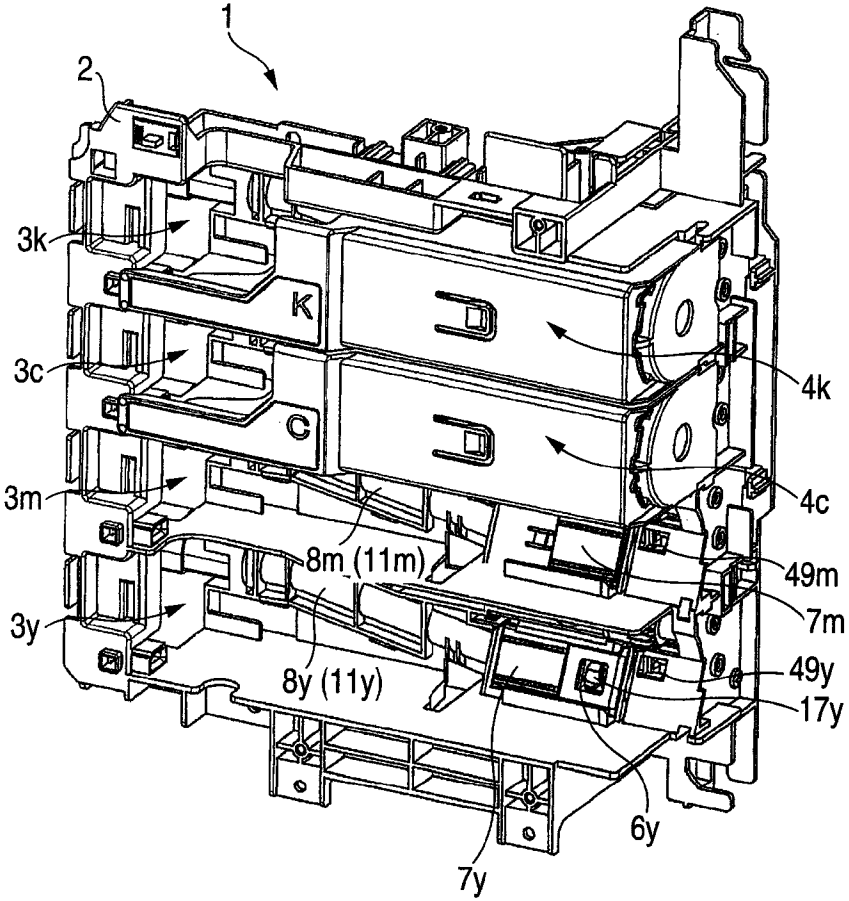
FIG. 5A is an explanatory view thereof when viewed from a obliquely rear direction.

FIG. 5 is an explanatory view illustrating a developer conveyance device according to the exemplary embodiment 1 of the invention. FIG. 5A is an explanatory view thereof when viewed from an obliquely rear side. FIG. 5B is a view thereof when viewed from a direction of the arrow VB shown in FIG. 5A.

In the following description, since members corresponding to the colors of Y, M, C, and K have the same configuration, corresponding reference signs in the drawings are represented by adding suffixes of y, m, c, and k, and sometimes the suffixes may be omitted in this application in order to facilitate understanding of the description.

In FIGS. 4 and 5, the developer conveyance device 1 is supported and fixed on the right inside of the image forming apparatus body U1. The developer conveyance device 1 has a frame body 2. In the frame body 2, four cartridge mounting portions 3 on which four toner cartridges TCy, TCm, TCc, and TCk of Y, M, C, and K are mounted in order from the lower portion are formed.

In FIGS. 3 to 5, in the cartridge mounting portions 3, cartridge containers 4 (in FIG. 5A, only the containers of C and K colors are illustrated, and the other containers of Y and M colors are omitted) that can contain the toner cartridges TCy, TCm, TCc, and TCk, respectively, are supported so as to be rotatable about rear end portions as rotational axes. In the exemplary embodiment 1, the toner cartridges TCy to TCk are detachable from a take-out position shown in FIG. 4. When the printer U is in use, the cartridge containers 4 are rotated from the take-out position to the inside, and then only the toner cartridges TCy to TCk are shifted frontward. Thereby, the toner cartridges TCy to TCk move to the mounting position shown in FIG. 3.

In FIG. 5, on the rear end portion of the cartridge mounting portions 3, inlet ports 6 (FIG. 5A illustrates only an inlet port of Y) through which developer sent from the toner cartridges TCy, TCm, TCc, and TCk flows are formed. In a part of the inlet port 6 of each cartridge mounting portion 3, a shutter member 7 (see FIG. 5A) as an example of an inlet port blocking member is disposed. The shutter member 7 is movably supported between (i) an open position in which the inlet port 6 is opened as shown by the shutter member 7 of Y color in FIG. 5A and (ii) a close position in which the inlet port 6 is closed as shown by the shutter member 7 of M color in FIG. 5A.

Figure 6:
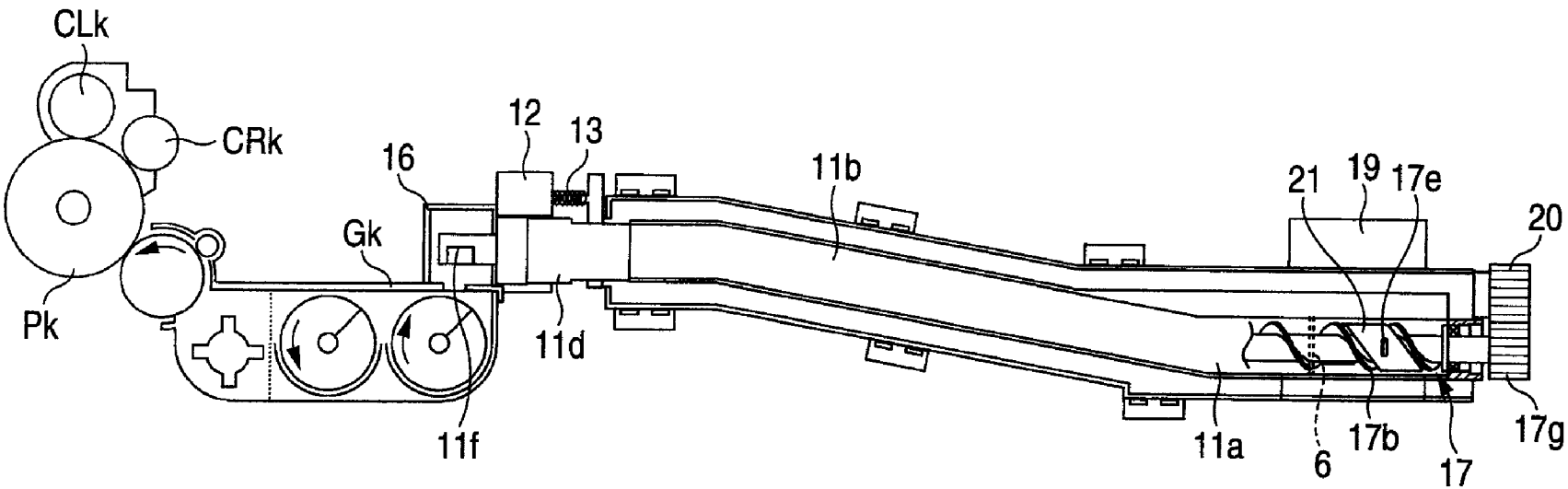
FIG. 6 is an explanatory view illustrating a relationship between the developer conveyance device and a developing device according to the exemplary embodiment 1 of the invention.

In FIGS. 5A and 5B, on the frame body 2, there are provided body-side conveyance-path forming concave portions 8 that are concave from an outer side and extend from the inlet ports 6 to the front side. On an inner surface of the frame body 2, conveyance-path forming members 9 (FIG. 5B illustrates only C and K colors) are mounted so as to correspond to the body-side conveyance-path forming concave portions 8. A cylindrical developer conveyance path 11 is formed by space surrounded by the body-side conveyance-path forming concave portions 8 and the conveyance-path forming members 9. In FIG. 6, the developer conveyance paths 11 extend toward the developing devices Gy to Gk. The developer conveyance path 11 according to the exemplary embodiment 1 is not formed in a linear shape but in a curved shape. The developer conveyance path 11 has an inflow-side horizontal conveyance portion 11*a* that extends from the inlet port 6, an inclination conveyance portion 11*b* that is inclined from the inflow-side horizontal conveyance portion 11*a* toward an upper part, and a development-side horizontal conveyance portion 11*d* that extends from the inclination conveyance portion 11*b* toward each of the developing devices Gy to Gk extending in the horizontal direction.

FIG. 6 is an explanatory view illustrating a relationship between the developer conveyance device and a developing device according to the exemplary embodiment 1 of the invention. In FIGS. 5B and 6, on the front side of the conveyance-path forming member 9, a developing-device connecting portion 9*a* constituting the development-side horizontal conveyance portion 11*d* is formed. An outlet port shutter 12 as an example of an outlet port blocking member is mounted on the developing-device connecting portion 9*a*. A spring 13 as an example of an elastic member always biases the outlet port shutter 12 toward a frontward close position. The outlet port shutter 12 blocks an outlet port 11*f* of the developer conveyance path 11 shown in FIG. 6. Accordingly, when the front cover U2 is opened and the developing devices Gy to Gk are detached, the outlet port shutter 12 is moved to the blocking position by the spring 13. When the developing devices Gy to Gk are attached, the outlet port shutters 12 are moved, and the developing-device connecting portions 9*a* are fitted to target connecting portions 16 (see FIG. 6) of the developing devices Gy to Gk. Therefore, it is possible to supply developer from the outlet ports (not shown in the drawings) to the developing devices Gy to Gk.

Figure 7:
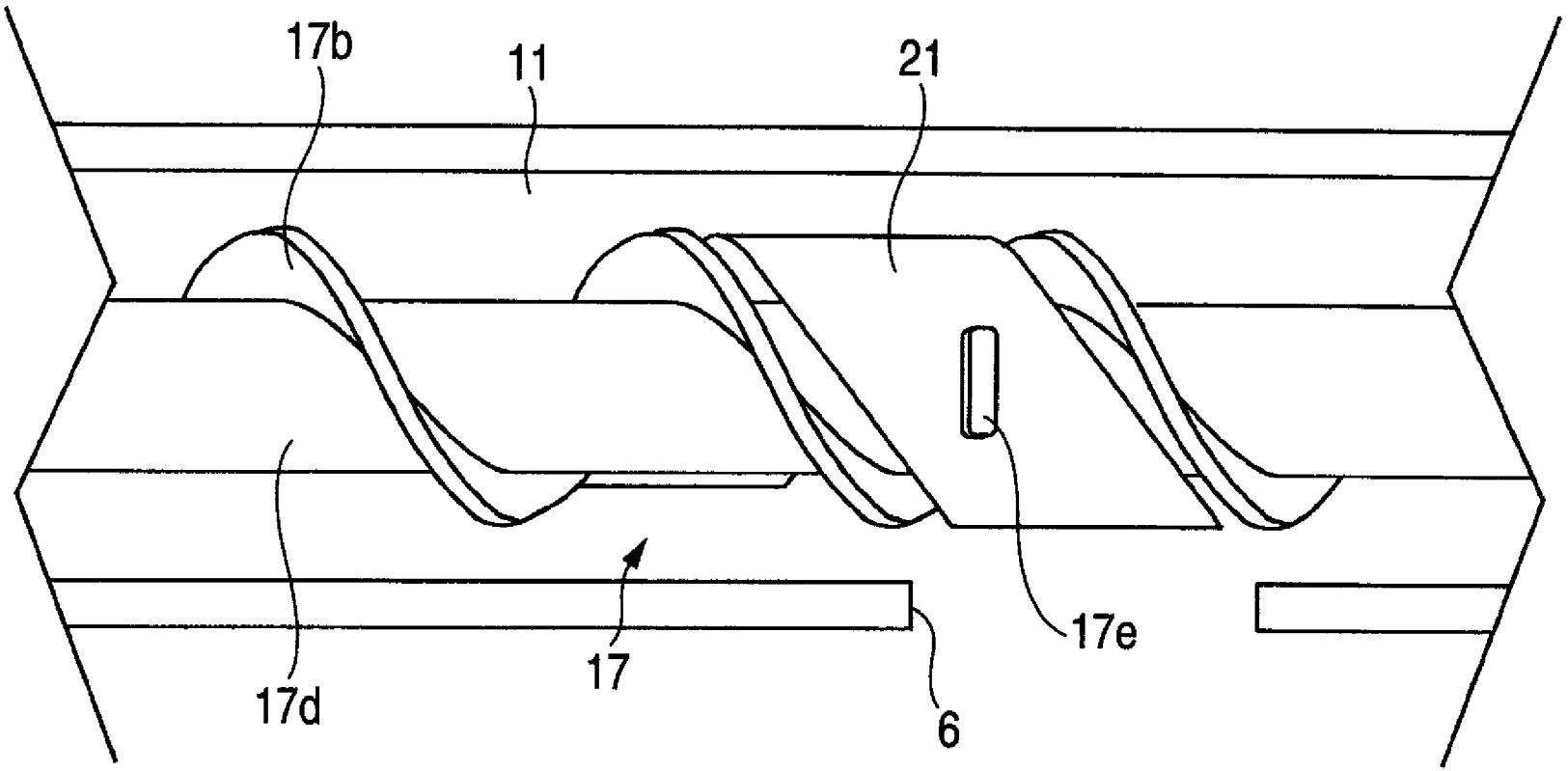
FIG. 7 is an enlarged explanatory view illustrating a main portion of an inlet port of the developer conveyance device according to the exemplary embodiment 1 of the invention.

FIG. 7 is an enlarged explanatory view illustrating a main portion of the inlet port of the developer conveyance device according to the exemplary embodiment 1 of the invention.

Figure 8:
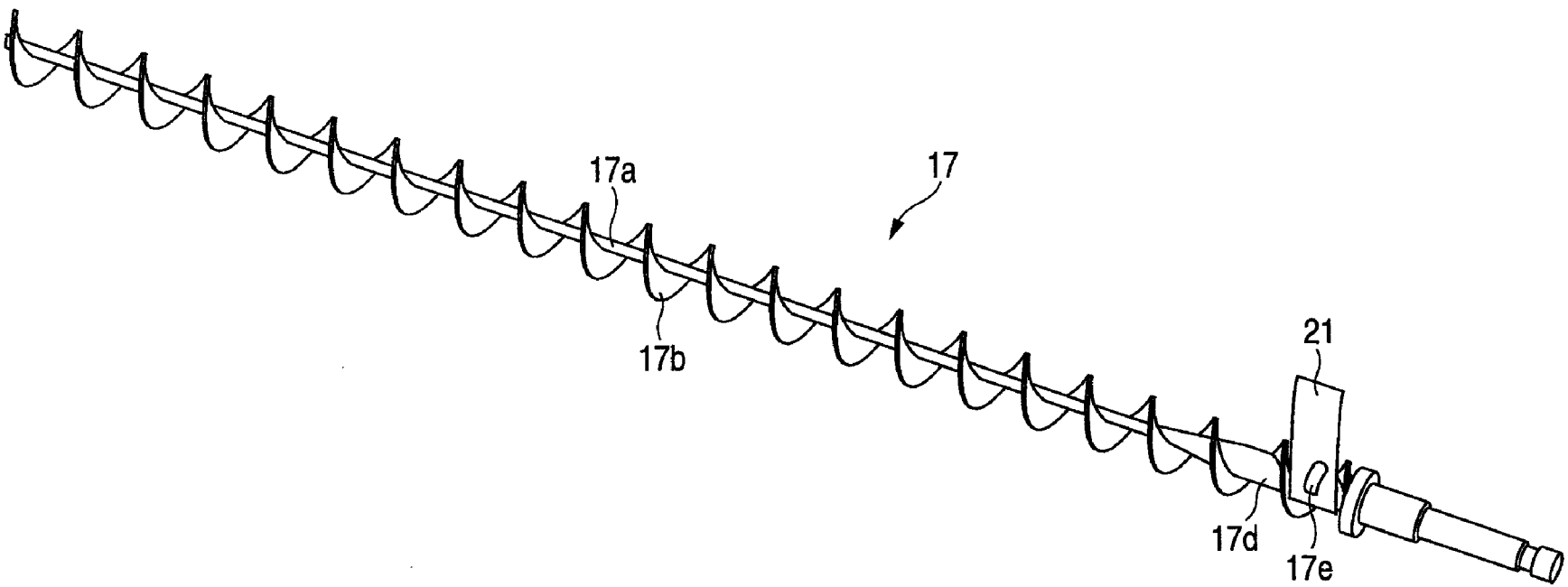
FIG. 8 is an explanatory view illustrating a developer conveyance member according to the exemplary embodiment 1 of the invention.

FIG. 8 is an explanatory view illustrating the developer conveyance member according to the exemplary embodiment 1 of the invention.

In FIGS. 5B, 6, and 7, in the developer conveyance path 11, a developer conveyance member 17 is rotatably supported along the curved developer conveyance path 11. In FIGS. 5 to 8, the developer conveyance member 17 includes a rotational shaft 17*a* and a helical-shaped conveyance vane 17*b* that is formed on an outer peripheral portion of the rotational shaft 17*a*. The developer conveyance member 17 according to the exemplary embodiment 1 is made of a resin material having flexibility, and conveys toner as an example of developer while bending into a shape following the developer conveyance path 11 as the developer conveyance member 17 rotates. In FIG. 7, a large-diameter portion 17*d* having a larger diameter than the rotational shaft 17*a* is formed on a position corresponding to the inlet port 6 of the developer conveyance member 17, and a clog prevention member mounting portion 17*e* is formed on the large-diameter portion 17*d*. In FIG. 5B, a supplying motor 19 for each color as an example of a supply driving system are supported in the rear end portion of the frame body 2. In FIG. 6, a driving gear 20 supported by a driving shaft 19*a* that extends from the supplying motor 19 transmits a drive force to a gear 17*g* supported by the rear end of the developer conveyance member 17, thereby driving the developer conveyance member 17 and conveying toner.

In FIGS. 7 and 8, an end portion of a clog prevention member 21 is supported by the clog prevention member mounting portion 17*e* of the developer conveyance member 17. The clog prevention member 21 according to the exemplary embodiment 1 is formed in a thin film shape with flexibility, and may be made of a resin such as PET (polyethylene terephthalate). The clog prevention member 21 goes into the inlet port 6 as the developer conveyance member 17 rotates, protrudes to the outside of the developer conveyance path 11, and breaks an aggregated developer adhering to the inlet port 6, thereby preventing the inlet port 6 from being clogged up with the toner. The developer conveyance device 1 according to the exemplary embodiment 1 includes the members represented by the reference numerals 2 to 21.

(Description of Developer Supply Container)

Figure 9:
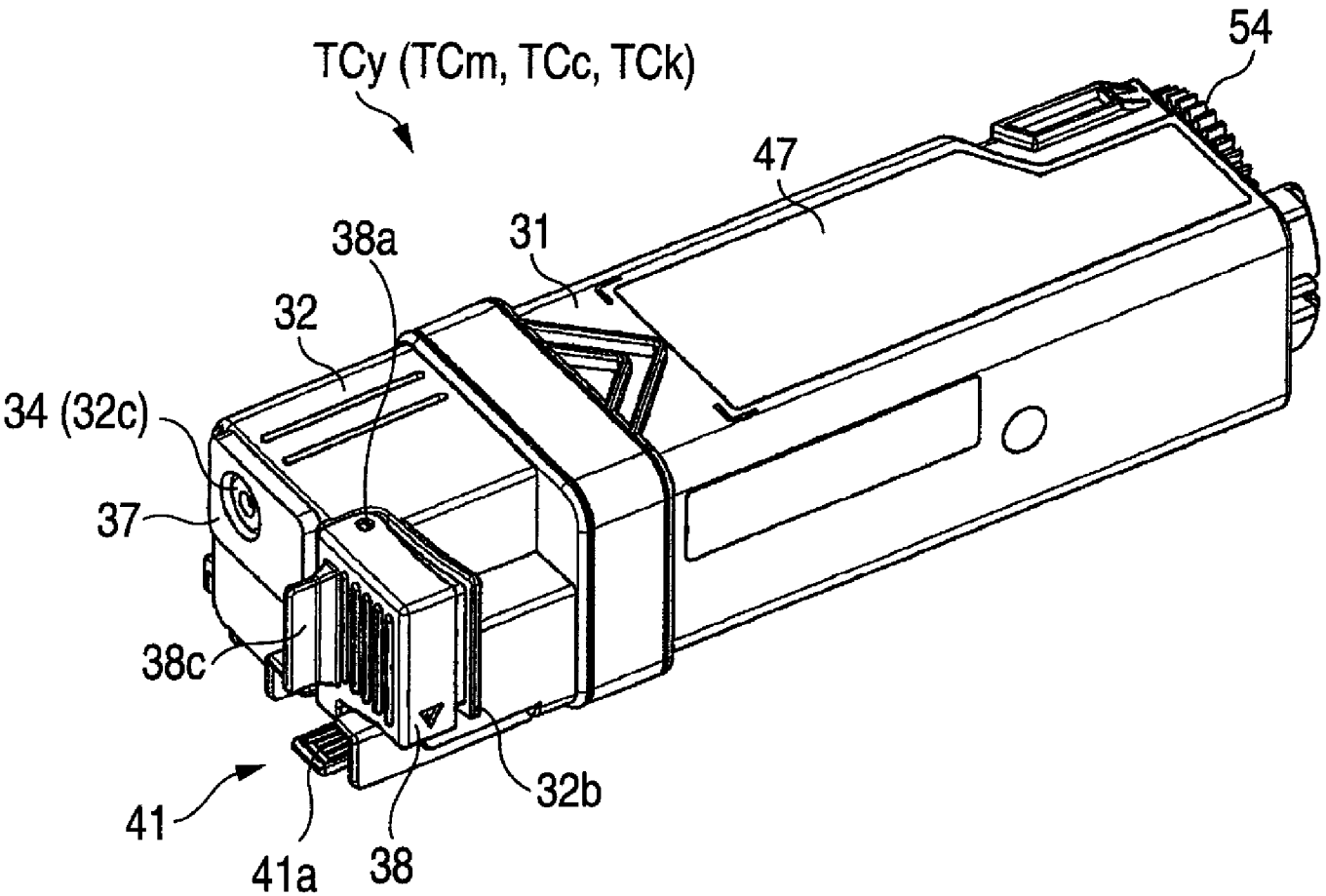
FIG. 9 is a perspective view of the developer supply container according to the exemplary embodiment 1 of the invention.

FIG. 9 is a perspective view of the developer supply container according to the exemplary embodiment 1 of the invention.

Figure 10:
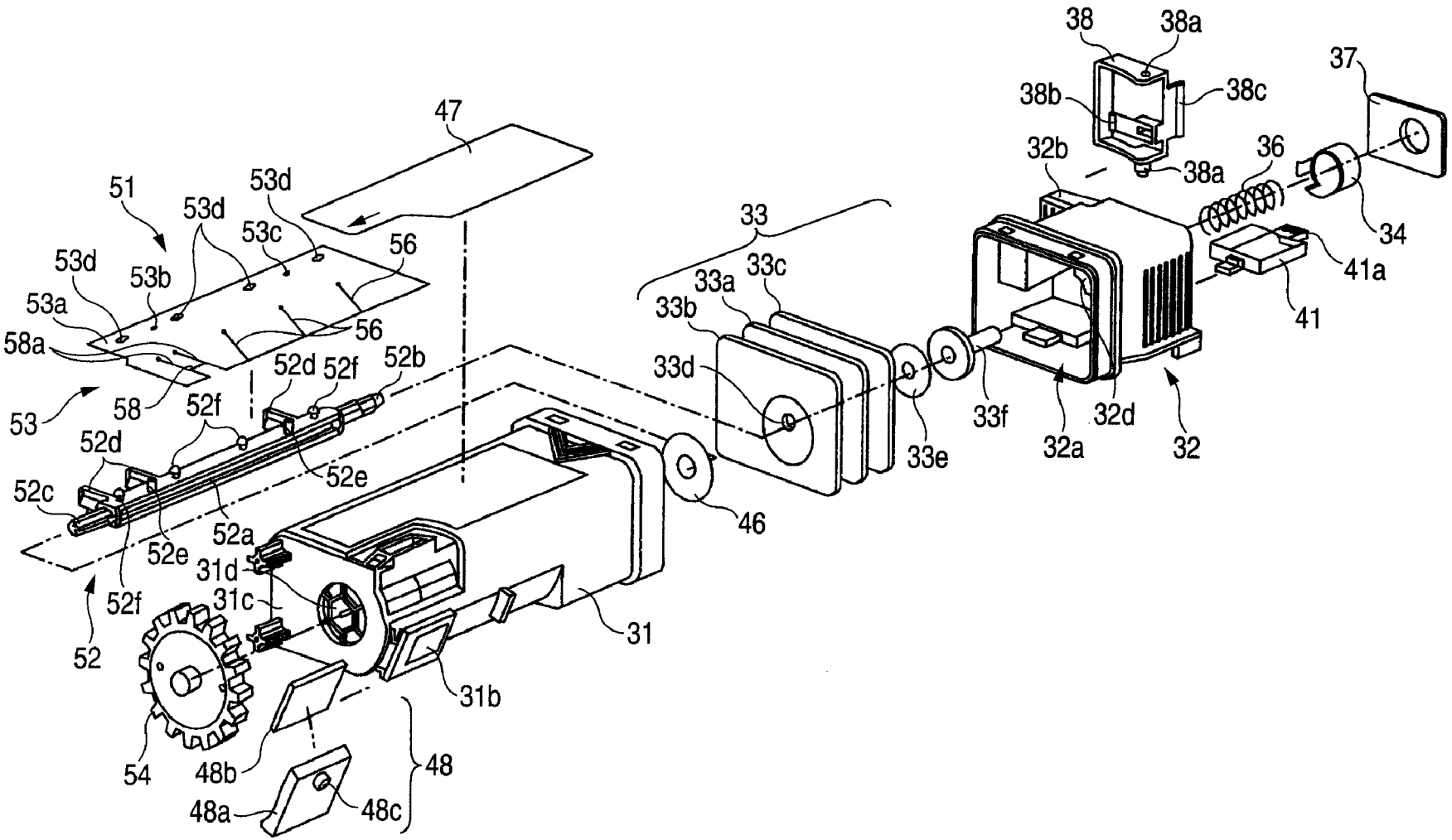
FIG. 10 is an exploded view illustrating the developer supply container according to the exemplary embodiment 1 of the invention.

FIG. 10 is an exploded view illustrating the developer supply container according to the exemplary embodiment 1 of the invention.

In FIGS. 3, 4, 9, and 10, each of the toner cartridges TCy to TCk as an example of the developer supply container according to the exemplary embodiment 1 includes: a box-shaped supply developer accommodation container 31 in which an opening for replenishing developer is formed at an end thereof; and a box-shaped waste-developer accommodation container 32 in which an opening opposed to the opening of the supply developer accommodation container 31 is formed. In FIG. 10, the supply developer accommodation container 31 and the waste-developer accommodation container 32 are partitioned by a partition member 33.

In FIG. 10, the partition member 33 includes a partition member body 33*a* formed of a plate-shaped resin, and seal members 33*b* and 33*c* formed of a plate-shaped elastic material are fixedly supported on the both sides of the partition member body 33*a*. A rotational shaft support through-hole 33*d* is formed on the partition member 33. A shaft-end support member 33*f* is fixedly supported through a ring-shaped seal member 33*e* at the seal member 33*c* of the waste-developer accommodation container 32 side so as to correspond to the end portion of the rotational shaft through-hole 33*d*. In addition, in the exemplary embodiment 1, the seal members 33*b* and 33*c* and the ring-shaped seal member 33*e* are made of rubber. In addition, the seal members 33*b* and 33*c* are not limited to the configuration that the seal members are formed in a plate shape. However, the seal members may be configured so as to surround peripheral edge of the partition member body 33*a* and may be formed by the two-color molding. Further, the shaft-end support member 33*f* may be integrally formed with the partition member body 33*a* with the ring-shaped seal member 33*e* being omitted.

Inside the waste-developer accommodation container 32, which is in the front side of each toner cartridges TCy to TCk, a waste-developer containing space 32*a* is formed by space sealed by the partition member 33 and the waste-developer accommodation container 32. The waste-developer containing space 32*a* contains waste developer collected by the photoconductor cleaners CLy to CLk and the belt cleaner CLb at the time of image forming operation. In FIGS. 4, 9, and 10, a handle fixing portion 32*b* is integrally formed in a right portion of the front side of the waste-developer accommodation container 32. In FIGS. 4 and 9, a waste-developer inlet port 32*c* that connects the waste-developer containing space 32*a* to the outside is formed in a left-upper portion of the front end of the waste-developer accommodation container 32. In FIG. 10, in the waste-developer containing space 32*a*, a bias-member support portion 32*d* is formed in the rear of the waste-developer inlet port 32*c*.

A waste developer shutter 34 as an example of an inlet port openable member that opens and closes the waste-developer inlet port 32*c* is supported in the waste-developer inlet port 32*c*. A shutter spring 36 as an example of a bias member is mounted between the waste developer shutter 34 and the bias-member support portion 32*d*. The shutter spring 36 gives a bias force to the waste developer shutter 34 to be located at a block position where the waste-developer inlet port 32*c* shown in FIGS. 4 and 9 is blocked. When the toner cartridges TCy to TCk are mounted on the image forming apparatus body U1 as shown in FIG. 3, a waste-developer conveyance path extending from each of the photoconductor cleaners CLy to CLk pushes the waste developer shutter 34 to the inside against the bias force of the shutter spring 36, and the waste developer can flow from the waste-developer conveyance path into the waste-developer containing space 32*a*.

In FIGS. 4, 9, and 10, an inlet-port leakage prevention member 37 surrounding the outer periphery of the waste-developer inlet port 32*c* is fixedly supported on the front surface of the waste-developer accommodation container 32. The inlet-port leakage prevention member 37 according to the exemplary embodiment 1 is formed of a foamed member having a so-called sponge shape.

In the handle fixing portion 32*b* of the waste-developer accommodation container 32, a handle 38 as an example of a grip member that is held by a user in order to manipulate the toner cartridges TCy to TCk is supported so as to be rotatable about a rotational center 38*a*. The handle 38 has a leaf spring portion 38*b*. The leaf spring portion 38*b* gives a bias force to the handle 38 in a direction apart from the handle fixing portion 32*b*. In FIGS. 4 and 10, in a right portion of the front side of the handle 38, a locked portion 38*c* having a nail shape as an example of a fixing target portion is formed so as to be locked into the locking portion 39 as an example of a fixing portion of the image forming apparatus body U1. Accordingly, when the toner cartridges TCy to TCk are moved to the mounting positions shown by the toner cartridge TCc corresponding to C color as in FIGS. 3 and 4, the locked portion 38*c* is caught by the locking portion 39 due to the bias force of the leaf spring portion 38*b* and locked (fixed) by the locking portion 39. When the toner cartridges TCy to TCk are moved from the mounting positions shown in FIG. 3 to the ejecting positions shown in FIG. 4, firstly, a user holds and rotates the handle 38, specifically, the user holds the handle fixing portion 32*b* and the handle 38, there releasing the locking state between the locked portion 38*c* and the locking portion 39. When the locking state is released, it becomes possible to move the toner cartridges TCy to TCk rearward. When the cartridge containers 4 are rotated, the toner cartridges TCy to TCk are moved to the take-out positions.

In FIGS. 4, 9, and 10, on the lower side of the front side of the waste-developer accommodation container 32, a storage member 41, that is, a so-called CRUM (Customer Replaceable Unit Memory) is detachably held. The storage member 41 stores information about each of the toner cartridges TCy to TCk, that is, for example, information as to whether or not the toner cartridge is unused, whether or not the toner cartridge does not contain developer therein, and how long an accumulated use time is. The storage member 41 has a terminal portion 41*a*. The storage member 41 is configured so that when each of the toner cartridges TCy to TCk is moved to the mounting position, the storage member 41 can connect to a terminal portion (not shown in the drawings) provided on the image forming apparatus body U1 and information can be written into the storage member 41.

Figure 11:
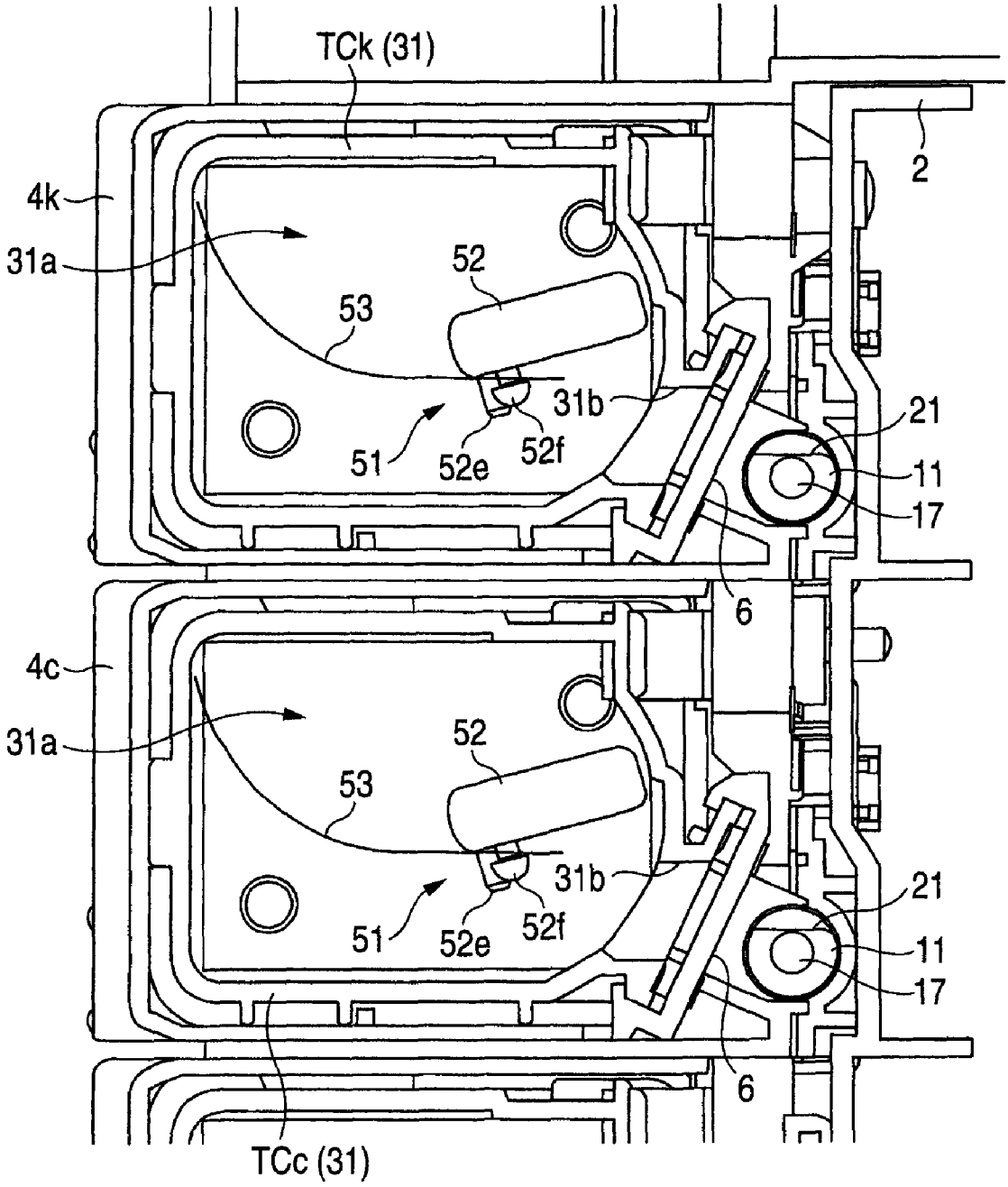
FIG. 11 is a sectional explanatory view illustrating the developer supply container according to the exemplary embodiment 1 of the invention.

FIG. 11 is a sectional explanatory view illustrating the developer supply container according to the exemplary embodiment 1 of the invention.

In FIGS. 4, 9, and 11, inside the supply developer accommodation container 31, which is on the rear side of the toner cartridges TCy to TCk, the supply developer containing space 31*a* is formed by the space that is sealed by the partition member 33 and the supply developer accommodation container 31. The supply developer containing space 31*a* contains developer supplied to each of the developing devices Gy to Gk at the time of the image forming operation. In the right lower portion of the rear end of the supply developer accommodation container 31, there is provided a supply developer outlet port 31*b* as an example of an outlet port that communicates with the supply developer containing space 31*a* and is connected to the inlet port 6 of the developer conveyance device 1. In a rear end wall 31*c* of the supply developer accommodation container 31, a shaft support through-hole 31*d* is formed so as to penetrate the wall in a frontward and backward direction. In an outer periphery of the shaft support through-hole 31*d* inside the rear end wall 31*c*, a ring-shaped seal member 46 is fixedly supported in order to prevent developer from leaking from the supply developer containing space 31*a* through the shaft support through-hole 31*d*.

In FIG. 9, an information description member 47, that is, a so-called label in which information about each of the toner cartridges TCy to TCk is described is attached to an upper face of the supply developer accommodation container 31.

In FIG. 10, in the supply developer outlet port 31*b*, a cartridge shutter 48 is supported so as to be slidably movable in the frontward and backward direction. The cartridge shutter 48 as an example of an outlet port openable member opens and closes the supply developer outlet port 31*b*. The cartridge shutter 48 includes: a shutter body 48*a*; a so-called seal member 48*b*, that is, a shutter member that is made of a rubber and is attached to the supply developer outlet port 31*b* side of the shutter body 48*a*; and a fixing protrusion 48*c*. In a state where the cartridge container 4 is rotated to the inside and received at the time of mounting each of the toner cartridges TCy to TCk, the fixing protrusion 48*c* is fitted, in the frame body 2 of the developer conveyance device 1, to the shutter fixing portion 49 (see FIG. 5) formed in the rear end side of the inlet port 6 and regulates the cartridge shutter 48 not to move. Accordingly, when the cartridge containers 4 is rotated to the inside and received, the fixing protrusion 48*c* is caught and fixed by the shutter fixing portion 49, and when each of the toner cartridges TCy to TCk is shifted, the supply developer outlet port 31*b* is relatively moved with respect to the cartridge shutter 48, and the supply developer outlet port 31*b* is opened and closed.

Figure 12A:
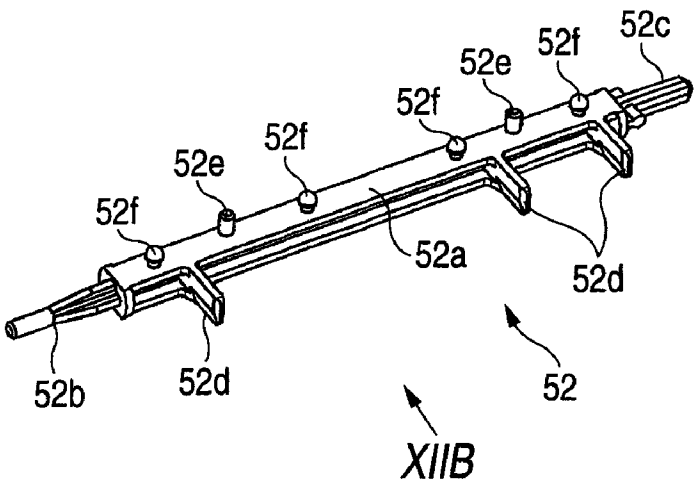
FIG. 12A is a perspective view thereof.
Figure 12B:
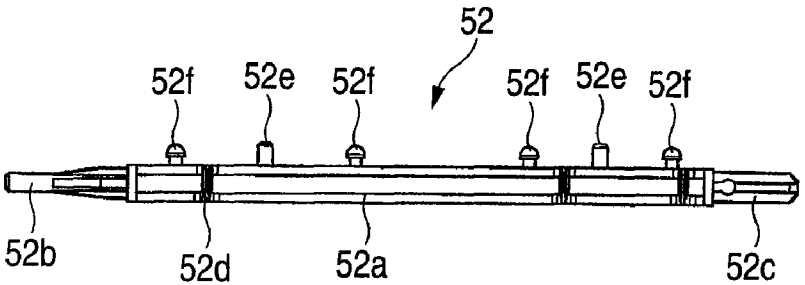
FIG. 12B is a side view thereof when viewed from the direction of an arrow XIIB in FIG. 12A.

FIG. 12 is an explanatory view illustrating a rotational shaft of an agitator as an example of the developer conveyance member according to the exemplary embodiment 1. FIG. 12A is a perspective view thereof. FIG. 12B is a side view thereof when viewed in a direction of the arrow XIIB in FIG. 12A. In FIGS. 9 to 11, inside the supply developer containing space 31*a*, the agitator 51 as an example of the developer conveyance member is supported so as to be rotatable. The agitator 51 has a rotational shaft 52 and a film member 53 serving as a conveyance-member body supported by the rotational shaft 52. In FIG. 12, the rotational shaft 52 has a rotational shaft body 52*a* that is formed in a rectangular pillar shape extending in the frontward and backward direction. A first support target portion 52*b* is formed on one end portion of the rotational shaft body 52*a* and is rotatably supported with being fitted to the shaft-end support member 33*f* of the partition member 33. A second support target portion 52*c* is formed on the other end portion of the rotational shaft body 52*a* and protrudes with passing through the shaft support through-hole 31*d* of the supply developer accommodation container 31.

In one side surface of the rotational shaft body 52*a*, plural stirring portions 52*d* for stirring developer are formed so as to protrude to the outside. In another side surface of the rotational shaft body 52*a* different from the stirring portions 52*d*, two film positioning convex portions 52*e* as an example of a conveyance-member body positioning portion are formed. On both sides of the film positioning convex portions 52*e*, film fixing portions 52*f* as an example of a conveyance-member body fixing portion are formed in a mushroom shape.

As shown in FIG. 11, in the agitator 51 according to the exemplary embodiment 1, the rotational shaft 52 is provided at a position that is not the center portion of the supply developer containing space 31*a* having the flat shape, but is apart from the center portion toward the supply developer outlet port 31*b*.

In FIGS. 9 and 10, a driving gear 54 is fixedly supported on the second support target portion 52*c* and transmits a driving force to the rotational shaft 52.

Figure 13:
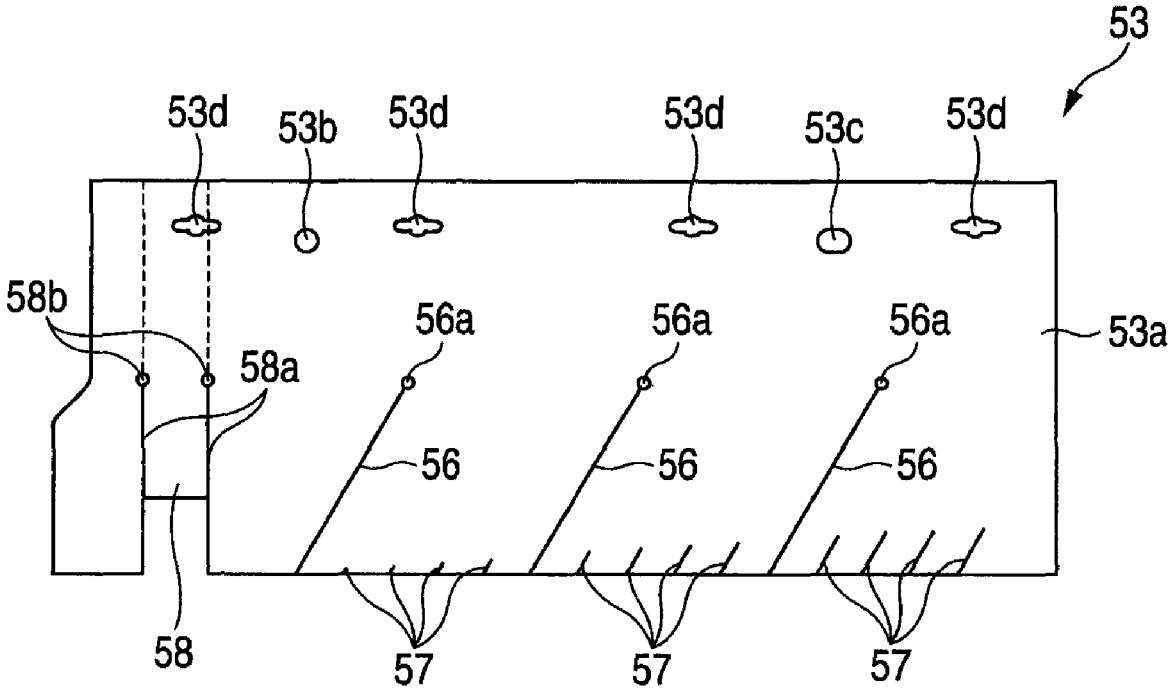
FIG. 13 is an explanatory view illustrating a film member as an example of a conveyance-member body of the agitator according to the exemplary embodiment 1.

FIG. 13 is an explanatory view illustrating a film member as an example of a conveyance-member body of the agitator according to the exemplary embodiment 1.

In FIGS. 10, 11 and 13, the film member 53 includes a film body 53*a* having a rectangular thin film shape. Positioning holes 53*b* and 53*c* are formed in a base end portion, supported by the rotational shaft 52, of the film body 53*a* so as to correspond to the positions of the two film positioning convex portions 52*e* of the rotational shaft 52. For the positioning operation, one of the positioning holes 53*b* and 53*c* is formed of a circular hole 53*b* and the other is formed of a long hole 53*c*. On the both sides of the positioning holes 53*b* and 53*c*, fixing target holes 53*d* are formed corresponding to the positions of the film fixing portions 52*f*. The fixing target holes 53*d* are formed in such a shape that a circular hole is formed in a center portion of a slit. The fixing target holes 53*d* are elastically deformed when the film fixing portions 52*f* penetrate therethrough. After the film fixing portions 52*f* pass through the fixing target holes 53*d*, the mushroom-shape front end portions of the film fixing portions 52*f* prevent the film fixing portions 52*f* from being dropped off.

In an edge portion of a free end side of the film body 53*a*, plural main conveyance slit portions 56 are formed at predetermined intervals. The plural main conveyance slit portions 56 are inclined toward the rear side, that is, the supply developer outlet port 31*b* side. In an end portion of each main conveyance slit portion 56 on the base end side, a slit growth prevention portion 56*a* having a circular hole shape is formed to prevent the slit from growing during the time of use. Between the main conveyance slit portions 56, plural sub conveyance slit portions 57 are formed. The sub conveyance slit portions 57 are formed so as to have a longer slit as it has more distance from the supply developer outlet port 31*b*.

A clog prevention member 58 is provided at a position, in the film body 53*a*, corresponding to the supply developer outlet port 31*b*. The clog prevention member 58 according to the exemplary embodiment 1 is defined by (i) a pair of slit portions 58*a* formed along a diameter direction of the rotational shaft 52 and (ii) a pair of virtual lines (shown by the dotted lines in FIG. 13) extending from base ends of the pair of slit portions 58*a* to the base end (one side) of the conveyance-member body. Slit growth prevention portions 58*b* are formed in the end portions of the slit portions 58*a* on the base end side in the clog prevention member 58.

(Description of Length Relation of Clog Prevention Member)

Figure 14A:
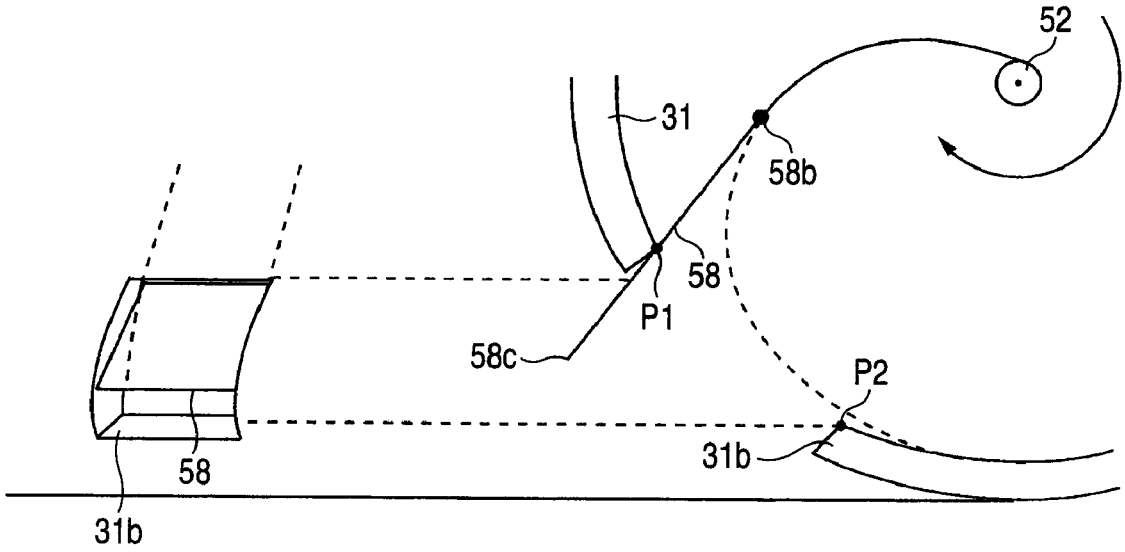
FIG. 14A is an explanatory view illustrating a state where the clog prevention member protrudes from the developer outlet port.
Figure 14B:
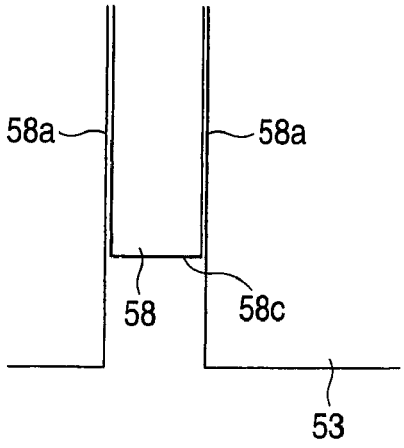
FIG. 14B is an explanatory view illustrating a free length of the clog prevention member.
Figure 14C:
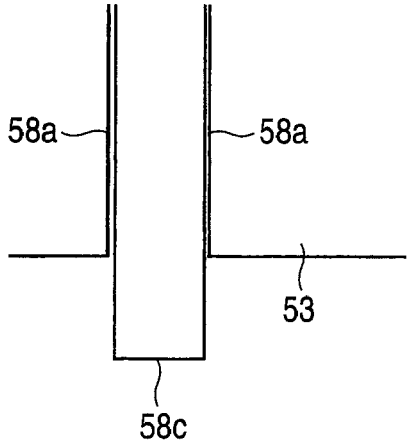
FIG. 14C is an explanatory view illustrating a free length of the clog prevention member according to a modified example of the exemplary embodiment 1.

FIG. 14 is an explanatory view illustrating a relationship between the clog prevention member and the supply developer outlet port according to the exemplary embodiment 1. FIG. 14A is an explanatory view illustrating a state where the clog prevention member protrudes from the developer outlet port. FIG. 14B is an explanatory view illustrating a free length of the clog prevention member. FIG. 14C is an explanatory view illustrating a free length of the clog prevention member according to a modified example of the exemplary embodiment 1.

Figure 15:
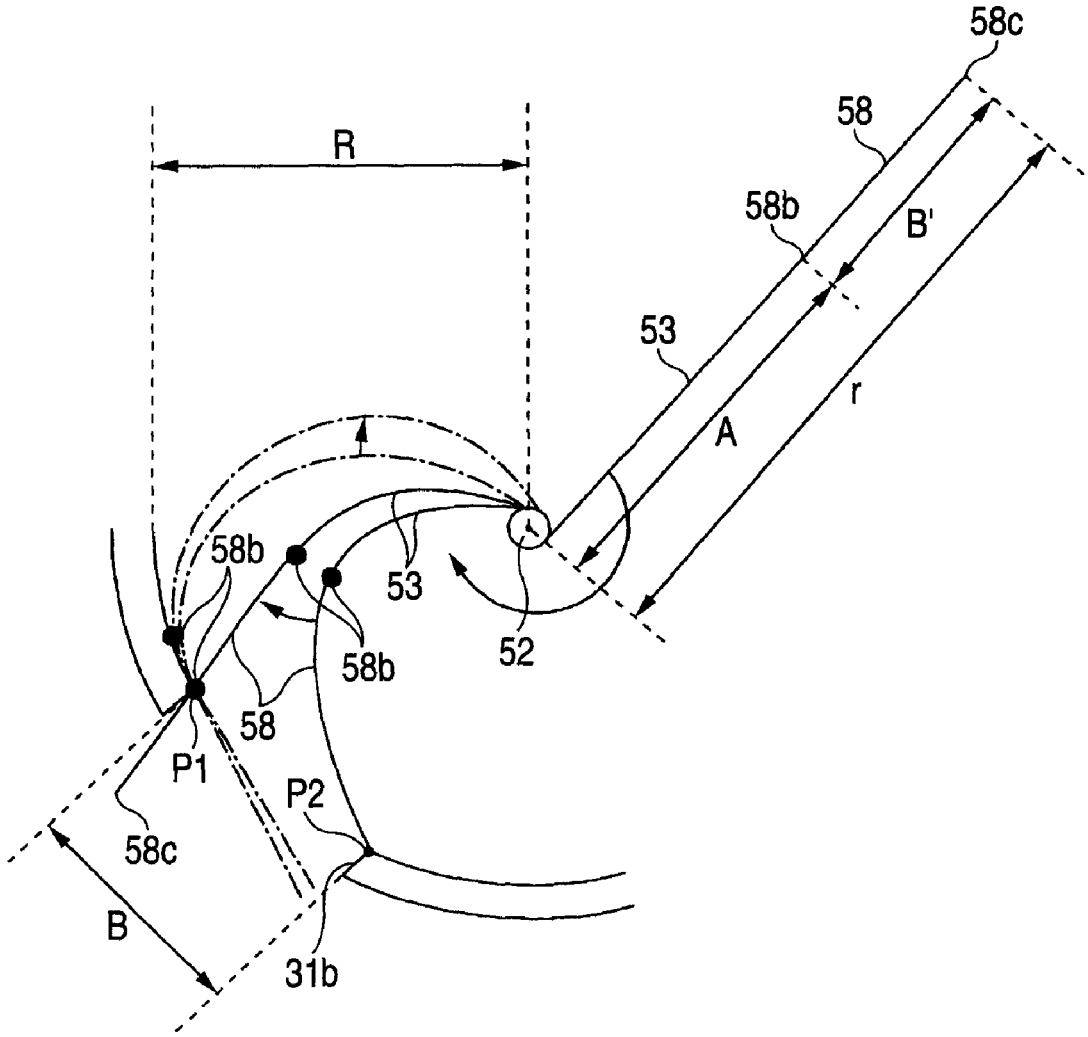
FIG. 15 is an explanatory view illustrating a relationship in length between the clog prevention member and the supply developer outlet port according to the exemplary embodiment 1.

FIG. 15 is an explanatory view illustrating a relation in length between the clog prevention member and the supply developer outlet port according to the exemplary embodiment 1.

In FIGS. 10, 13, 14A and 14B, in the film member 53 according to the exemplary embodiment 1, a free length that is a length from a portion of the clog prevention member 58 in the rotational shaft 52 to the end portion 58*c* on the free end side is formed to be shorter than free lengths of portions other than the clog prevention member 58. As shown in FIG. 14C, a free length of the clog prevention member 58 may be longer than those of the other portions.

In FIG. 15, R and r is set to satisfy the following relation:

$$R<r$$

where r denotes the free length of the clog prevention member 58 and R denotes a distance from the rotational center of the rotational shaft 52 to the developer outlet port 31*b*. In other words, the film member 53 is configured so that its free length is long, and the film member 53 rotates in a bending state as shown in FIGS. 11, 14, and 15 and stirs and conveys the supply developer disposed inside.

Figure 16:
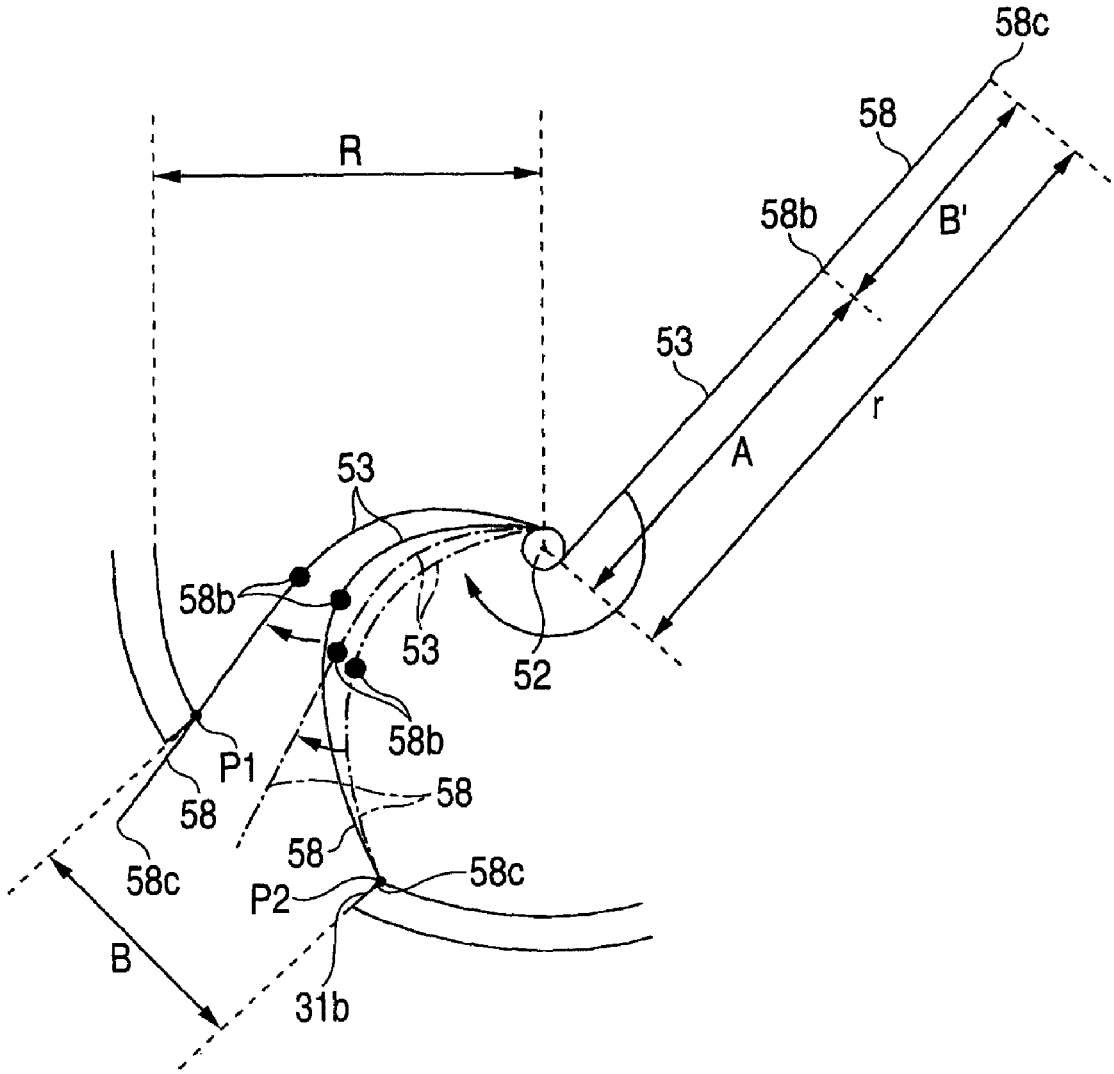
FIG. 16 is an explanatory view illustrating a relationship between a length from a base end portion of a slit portion to a free end portion of the clog prevention member and a width of the supply developer outlet port according to the exemplary embodiment 1.

FIG. 16 is an explanatory view illustrating a relationship between a length from the base end portion of the slit portion 58*a* to the free end portion of the clog prevention member 58 and a width of the supply developer outlet port according to the exemplary embodiment 1.

According to the exemplary embodiment 1, in FIG. 15, A and R are set so as to satisfy the following relation:

$$A<R$$

where A denotes a distance from the rotational center of the agitator 51 to the slit growth prevention portion 58*b*, that is, the end portion of the slit portion 58*a* on the base end side. Further, B and B' are set so as to satisfy the following relation:

$$B' \geqq B$$

where B denotes a width from an upstream end edge P2 of the supply developer outlet port 31*b* in the rotational direction of the rotational shaft 52 to a downstream end edge P1 of the supply developer outlet port 31*b* in the rotational direction of the rotational shaft 52, and B' denotes a length from the end portion 58*b* of the slit portion 58*a* on the base end side to the end portion 58*c* of the clog prevention member 58 on the free end side.

Accordingly, the agitator 51 according to the exemplary embodiment 1 is set so as to satisfy A<R. Therefore, when the end portion 58*c* of the clog prevention member 58 on the free end side detaches from the upstream end edges P2 as the rotational shaft 52 rotates, the agitator 51 goes into the supply developer outlet port 31*b*, and an amount of its protrusion to the outside increases as compared with the case of A≧R represented by the dotted line in FIG. 15. Also, the agitator 51 according to the exemplary embodiment 1 is set so as to satisfy B'≧B. Therefore, when the end portion 58*c* is detached from the upstream end edge P2 and moves at a high speed by an elastic restoration force as the rotational shaft 52 rotates, a region in which the end portion 58*c* of the clog prevention member 58 on the free end side moves at a fast speed widens as compared with the case of B'<B represented by the dotted line shown in FIG. 16.

(Operation of Exemplary Embodiment 1)

In the printer U as an example of the image forming apparatus according to the exemplary embodiment 1 having the configuration set forth above, when toner of the developing devices Gy to Gk is consumed in the image forming operation, the toner is discharged from the supply developer outlet port 31*b* to the inlet port 6 by rotating the agitator 51 of the toner cartridges TCy to TCk. The developer supplied to the inlet port 6 is conveyed and supplied by rotating the developer conveyance member 17 of the developer conveyance device 1.

In the agitator 51 according to the exemplary embodiment 1, the clog prevention member 58 that is disposed corresponding to the supply developer outlet port 31*b* periodically goes into the supply developer outlet port 31*b* as the agitator 51 rotates, as shown in FIG. 14. The developer adhering to the supply developer outlet port 31*b* is removed by the clog prevention member 58 that periodically goes into. If there is an aggregated developer, the clog prevention member 58 breaks the aggregated developer, and thus it is possible to prevent the supply developer outlet portion 31*b* from being clogged up.

Particularly, in the exemplary embodiment 1, A<R<r and B'≧B are satisfied. Also, the clog prevention member 58 moves at a high speed in the wide region in the supply developer outlet portion 31*b* and largely protrude to the outside. Thereby, the developer adhering to the supply developer outlet port 31*b* can be surely removed and it is possible to prevent the supply developer outlet port 31*b* from being clogged up.

MODIFIED EXAMPLE

As described above, the exemplary embodiment of the invention is described in detail. However, the exemplary embodiment shows an aspect of invention but does not limit the invention. The exemplary embodiment may be modified in various ways without departing from the technical spirit of the invention recited in claims. Modified examples (H01) to (H06) will be described below.

(H01) In the exemplary embodiment, a printer is introduced as an example of an image forming apparatus. However, the invention is not limited thereto. It is also possible to employ a multi functional printer having all or a part of functions such as a printer, a FAX, and a copier. In addition, the invention is not limited to an image forming apparatus of multi-color development. It is also possible to configure an image forming apparatus to use a single color such as black.

(H02) In the exemplary embodiment, A, R, r, B' and B satisfy the exemplary relationship described. However, the invention is not limited thereto. It is also possible to configure a desired length relationship may be set in accordance with design and specification.

(H03) In the exemplary embodiment, the clog prevention member 58 is provided by forming the slit portion 58*a* in the film member 53. However, the invention is not limited thereto. It is also possible to configure the clog prevention member by employing a member independent of the film member 53.

(H04) In the exemplary embodiment, the agitator as an example of the developer conveyance member includes the rotational shaft 52 and the film member 53. However, the invention is not limited thereto. It is possible to employ such a configuration that the agitator has a rotational shaft and a helical-shaped conveyance vane or any configuration of the known configurations.

(H05) In the exemplary embodiment, the toner cartridges TCy to TCk are an example of the developer supply container. However, the configuration of the developer supply container is not limited to the exemplified configuration according to the exemplary embodiment. It is possible to employ any desired configuration. For example, the developer supply container may be configured so that the waste-developer containing space is omitted. In addition, it is also possible to employ such a configuration that a direction of developer discharged by the supply developer outlet port is not the inclined direction but a horizontal or a gravitational direction.

(H06) Also, the configuration of the developer conveyance device 1 is not limited to the exemplified configuration according to the exemplary embodiment. It is possible to employ any desired configuration. For example, it is also possible to employ a storage container, that is, a so-called reserve tank that temporally stores and stirs the developer discharged from the developer supply container. Also, it is also possible to employ such a configuration that the toner cartridges TCy to TCk are disposed adjacent to the developing devices Gy to Gk with the developer conveyance device 1 being omitted.

What is claimed is:

1. A developer supply container comprising:

a container body that includes an outlet port and contains developer therein;

a developer conveyance member that includes:

a rotational shaft, and a conveyance-member body that is supported by the rotational shaft and has flexibility, the developer conveyance member that is disposed in the container body and conveys the developer to the outlet port for discharge; and a clog prevention member formed in the conveyance-member body in a position corresponding to the outlet port, the clog prevention member that goes into the outlet port to protrude to outside of the container body in response to a rotation of the rotational shaft, wherein a length, in a radial direction from the rotational shaft, of the clog prevention member is shorter than a length, in the radial direction from the rotational shaft, of portions of the conveyance-member body in regions axially adjacent to the clog prevention member.

2. The developer supply container according to claim 1, wherein the clog prevention member is defined by slit portions formed in the conveyance-member body, and the following expression is satisfied:

$$A \leqq R < r$$

where R denotes a distance from an inner wall, in a position of the outlet port, of the container body to a center of the rotational shaft, A denotes a distance from the center of the rotational shaft to the base ends of the slit portions, and r denotes a distance from the center of the rotational shaft to an end portion of the clog prevention member on a free end side.

3. The developer supply container according to claim 2, wherein the following expression is satisfied:

$$B' \geqq B$$

where B denotes a width from an upstream end edge of the outlet port in a rotational direction of the rotational shaft to a downstream end edge of the outlet port in the rotational direction of the rotational shaft, and B' denotes a distance from the base ends of the slit portions to the end portion of the clog prevention member on the free end side.

4. The developer supply container according to claim 2, wherein growth preventing portions are formed in the base ends of the slit portions, and the growth prevention portions prevent the slit portions from growing during use of the developer conveyance member.

5. An image forming apparatus comprising:

an image carrier;

a developing device that develops a latent image on a surface of the image carrier into a visible image;

the developer supply container according to claim 1 that contains new developer to be supplied to the developing device;

a transfer device that transfers the visible image developed by the developing device to a medium; and a fixing device that fixes the transferred visible image on the medium.

6. The developer supply container according to claim 1, wherein the conveyance-member body comprises a helical shaped conveyance vane and the clog prevention member is separated from adjacent portions of the conveyance-member body by a thin slit.

7. The developer supply container according to claim 1, wherein the conveyance-member body comprises a helical shaped conveyance vane and the clog prevention member comprises a thin flexible film attached to the rotational shaft between adjacent vane portions of the helical shaped conveyance vane.

* * * * *